US005511447A

United States Patent [19]

Galloway et al.

[11] Patent Number: 5,511,447

[45] Date of Patent: Apr. 30, 1996

[54] AUTOMATIC RATCHET BLOCK

[76] Inventors: Peter E. Galloway, 26 Friendlee La., Wilton, Conn. 06897; Peter L. Wilson, 722 Silvermine Rd., New Canaan, Conn. 06840

[21] Appl. No.: 214,853

[22] Filed: Mar. 18, 1994

Related U.S. Application Data

[63] Continuation-in-part of Ser. No. 905,725, Jun. 29, 1992, Pat. No. 5,319,997.

[51] Int. Cl.[6] ..... G05G 1/00; B66D 1/14

[52] U.S. Cl. ..... 74/577 S; 74/575; 74/577 R; 74/505; 74/506; 192/46; 254/352; 254/266

[58] Field of Search ..... 192/45, 43.1, 47; 254/353, 352, 266, 306; 74/575, 577 R, 577 S, 577 SF, 578, 504–507, 543; 188/63, 82.7; 242/219

[56] References Cited

U.S. PATENT DOCUMENTS

| | | | |
|---|---|---|---|
| 632,910 | 9/1899 | Wiley | 254/353 |
| 2,184,149 | 12/1939 | Marr | 74/505 X |
| 2,633,953 | 4/1953 | Gorske | 192/47 |
| 2,690,240 | 9/1954 | Schroeder | 74/505 X |
| 2,708,555 | 5/1955 | Heinemann et al. | 242/99 |
| 2,718,949 | 9/1955 | Taylor | 192/47 |
| 3,421,605 | 1/1969 | Hansen | 192/46 X |
| 3,606,940 | 9/1971 | Finkeldei | 192/46 X |
| 3,829,041 | 8/1974 | Nepote | 242/218 |
| 4,028,954 | 6/1977 | Mehnert | 192/46 X |
| 4,093,185 | 6/1978 | Newell | 74/505 X |
| 4,130,271 | 12/1978 | Merriman | 192/46 X |
| 4,496,115 | 1/1985 | Kreft et al. | 242/84.1 R |
| 4,685,632 | 8/1987 | Yeh | 74/577 S |
| 4,702,486 | 10/1987 | Tsuchie | 132/46 X |
| 4,977,795 | 12/1990 | McVey | 74/575 |

FOREIGN PATENT DOCUMENTS

| | | | |
|---|---|---|---|
| 1029727 | 6/1953 | France | 74/577 S |
| 36518 | 9/1935 | Netherlands | 192/46 |
| 165163 | 6/1921 | United Kingdom | 192/46 |

*Primary Examiner*—Vinh T. Luong
*Attorney, Agent, or Firm*—Haynes N. Johnson

[57] ABSTRACT

A ratchet block comprised of a frame, movable sheave assembly, ratchet assembly, ratchet assembly and cam wherein the ratchet automatically engages under load permitting rotation of the sheave in only one direction, and disengages when the load is removed permitting rotation in both directions. This automatic engagement and disengagement of the ratchet to increase or reduce friction when a rope or wire is run through the sheave does not require the user to disengage the ratchet mechanism with a conventional switch.

1 Claim, 6 Drawing Sheets

AUTOMATIC RATCHET BLOCK

This is a continuation in part of application Ser. No. 07/905,725 filed Jun. 29, 1992 now U.S. Pat. No. 5,319,997 issued on Jun. 14, 1994.

FIELD OF THE INVENTION

The present invention relates to an improvement over conventional ratchet blocks, especially suitable for use on sail boats, but applicable to any field where ratchet blocks are used.

BACKGROUND OF THE INVENTION

Ratchet blocks typically consist of a sheave rotatably mounted on a shaft between two side plates and a ratchet assembly inside the sheave to allow rotation in one direction only when engaged, and in both directions when disengaged. Typically a ratchet arm is engaged with teeth on the inside of the sheave (or disengaged) by a mechanical switch, which can be thrown only when there is little or no pressure/load on the sheave. Thus if the user wants to shift the block from a ratcheting mode to a freewheeling mode (rotate in either direction) for reduced friction, or from the freewheeling to ratcheting mode to increase, he must physically move to reach the switch with a hand, and concurrently remove the load from any line or wire that is running through the block. In many instances it is not possible to do either, so there is significant friction when the line or wire is eased out through the block as the sheave will not rotate in the direction of easing, or the benefit of ratcheting cannot be attained.

In sailboat racing, where the use of conventional ratchet blocks is widespread, the high friction caused by a ratchet-engaged non-rotating sheave helps reduce the effort required to pull a line through a block under load. However, this friction: 1) reduces the speed by which sailors can execute sail changes such as taking down the spinnaker; 2) encumbers rapid easing of a line attached to a sail; and 3) slows down sail adjustment required for rapid alteration of course and tacking/jibing. The advantage of friction caused by engaging the ratchet when trimming sails is a disadvantage when easing them.

Further, because conventional ratchet blocks require manual switching to change from the ratchet-engaged to freewheeling mode and vice versa, they can only be located where they can be easily reached. On sailboats, this precludes their use high on the mast for halyards, or in other areas where the crew can't normally reach while sailing. It is therefore an objective of the present invention to automatically provide load dependent ratchet action for increased friction and freewheeling for significantly reduced friction, without the manual switching of conventional ratchet blocks. It is also an objective to expand the number of locations for using a ratchet block beyond those normally within easy reach. Further, it is an object of the present invention to provide such a device which is easy and inexpensive to manufacture.

BRIEF SUMMARY OF THE INVENTION

The present invention relates to a ratchet block assembly comprising:

a) a frame with two walls joined at at least one end having a fixed axis between the walls serving as the shaft for a movable sheave assembly;

b) a movable sheave assembly inside the frame comprising two side plates and a freely rotating sheave having teeth around the interior for engagement of a ratchet assembly, with the sheave having means to rotate in at least two different positions about the shaft; and c) a ratchet assembly comprising a cam having means to move about the shaft, an articulated ratchet arm, and means to concurrently engage the ratchet arm with the sheave's teeth and to provide contact between the cam and said ratchet arm.

The sheave rotates freely in either direction when no load is placed upon it, and when a load is placed on the sheave, the sheave assembly moves towards the cam and causes the ratchet arm to engage the sheave's teeth thereby permitting rotation in only one direction. This engagement of the ratchet arm is automatic and does not require a conventional switch. The sheave assembly has means to move away from the cam when the load is removed, thereby automatically disengaging the ratchet arm from sheave's teeth allowing free rotation in either direction. This automatic disengagement of the ratchet arm, which allows the sheave to rotate freely in either direction, significantly reduces friction when a rope or wire is run through the sheaves, and thus does not require the user to disengage the ratchet mechanism with a conventional switch.

In a particularly preferred embodiment, the present invention comprises a bearing block with a movable sheave assembly and a ratchet assembly activated by the sheave's position relative to a cam. The sheave assembly has an oval shaft aperture slightly larger than the diameter of the shaft fixed to the block frame, enabling it to rotate in two different positions, one at each end of the shaft aperture. When loaded (pressure generated by tension on the line or wire passing through the block), the sheave assembly is pulled toward the general direction of the load, forcing an articulated ratchet arm against a cam such that it engages teeth on the inside of the sheave. The teeth engaging end of the ratchet arm prevents rotation in one direction but allows it in the other. When the load is released, a compression spring at one end of the frame pulls the sheave assembly away from the direction of the released load. In this position, the pressure of the cam no longer forces the ratchet arm to engage, and a coil spring pulls the arm away from the sheave teeth, allowing the sheave to rotate freely in either direction (free wheel).

This automatic disengagement of the ratchet arm will occur when the user releases the line or wire running through the block because it will remove the load pressure on the sheave, and the compression spring will move the sheave assembly back to its original position. Instead of staying in the ratchet mode (preventing rotation in one direction), the sheave will freewheel and allow the line to run out through the block with little or no friction. Thus someone on a sailboat, in this case, can cast off (let go) a sheet or halyard and have it run out much faster. This will speed up sail changes and maneuvers that require dramatic change in sail trim.

The ratchet block has a manual switch that allows the user to put in the "automatic" mode, where only a load will engage the ratchet arm, in the "on" mode, where the ratchet is always engaged, and the "off" mode where the block freewheels in both directions whether or not there is a load on the sheave.

In a modification of our invention the sheave assembly moves relative to the frame, and the ratchet assembly is fixed relative to the frame.

DESCRIPTION OF THE DRAWINGS

While the specification concludes with claims particularly pointing out and distinctly claiming the present invention, it is believed that the present invention will be better understood from the following description in conjunction with the accompanying drawings in which:

FIG. 13 is a perspective view of our ratchet block.

FIG. 14 is a section, taken on line 14—14 of FIG. 13, showing the ratchet block when it is carrying a load.

FIG. 15 is a section, taken on line 15—15 of FIG. 13, showing the ratchet block when it is carrying a load.

FIG. 16 is similar to FIG. 14, except that the ratchet block is not carrying a load.

FIG. 17 is similar to FIG. 15, except that the ratchet block is not carrying a load.

FIG. 18 is a perspective view of the raceway used in the ratchet block.

DETAILED DESCRIPTION OF THE INVENTION

Although it is recognized that other configurations are possible, the drawings represent one specific embodiment of the invention. However, advantageous use of the self releasing ratchet block is in no way limited to sailing. The devices of the present invention may be used for any purpose where automatic engagement and disengagement of a ratchet mechanism is necessary or desirable.

Figure 1:
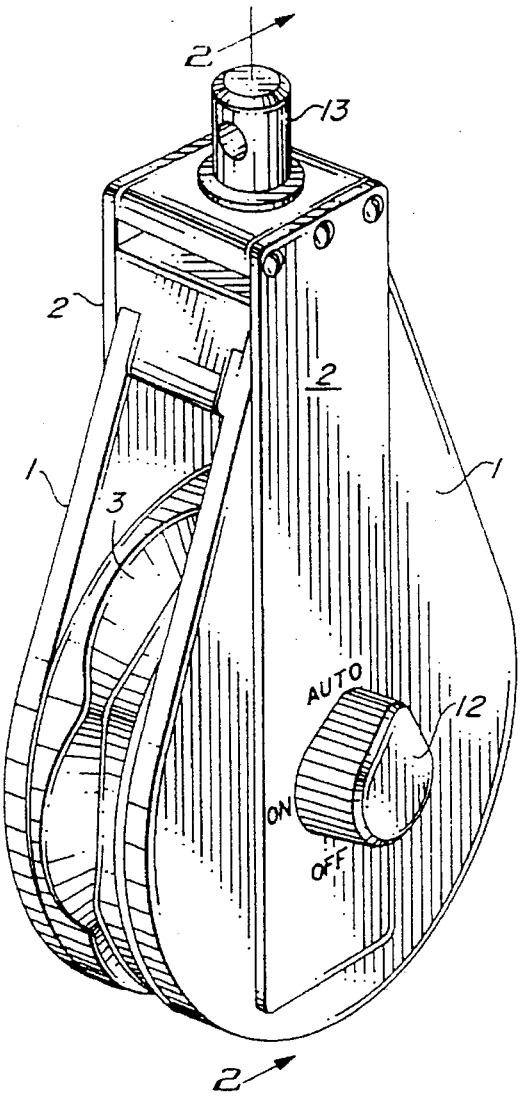
FIG. 1 shows an external view of the ratchet block.

FIG. 1 shows an external view of the ratchet block fully assembled. The sheave 3 is held between the side plates 17 and 17' of the sheave assembly 1, which is held in place by the frame 2. A switch 12 on each side of the block enables the user to put the block in three modes, automatic ratcheting (auto), always ratcheting (on), and always freewheeling (off).

Figure 2:
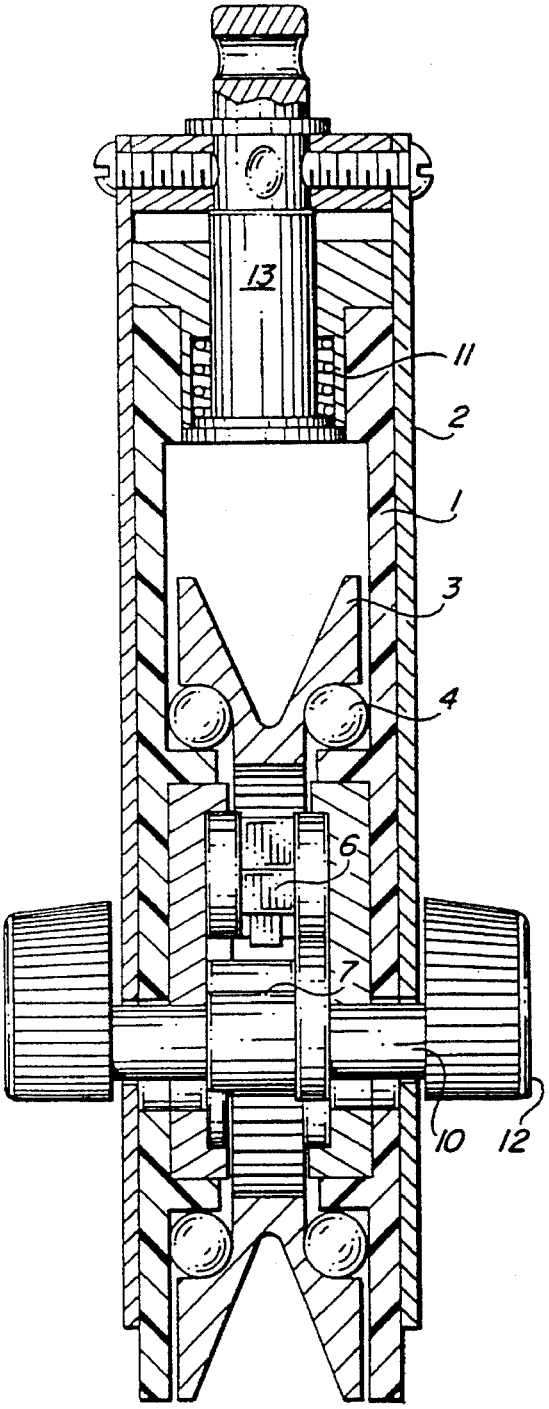
FIG. 2 is a transverse vertical section of the ratchet block.

FIG. 2 is a transverse section of the ratchet block. The sheave 3 with ball bearings 4 between the side plates of the sheave assembly 1, is held in place by the frame 2 composed of side plates 17 and 17' and end plate 18 and a centerpost 13. The cam 7 fixed upon the shaft 10 engages the ratchet arm 6 when a load is placed on the sheave 3 thereby moving the sheave 3 and sheave assembly 1 away from the end of the frame 2 and compressing the compression spring 11 about the centerpost 13.

Figure 3:
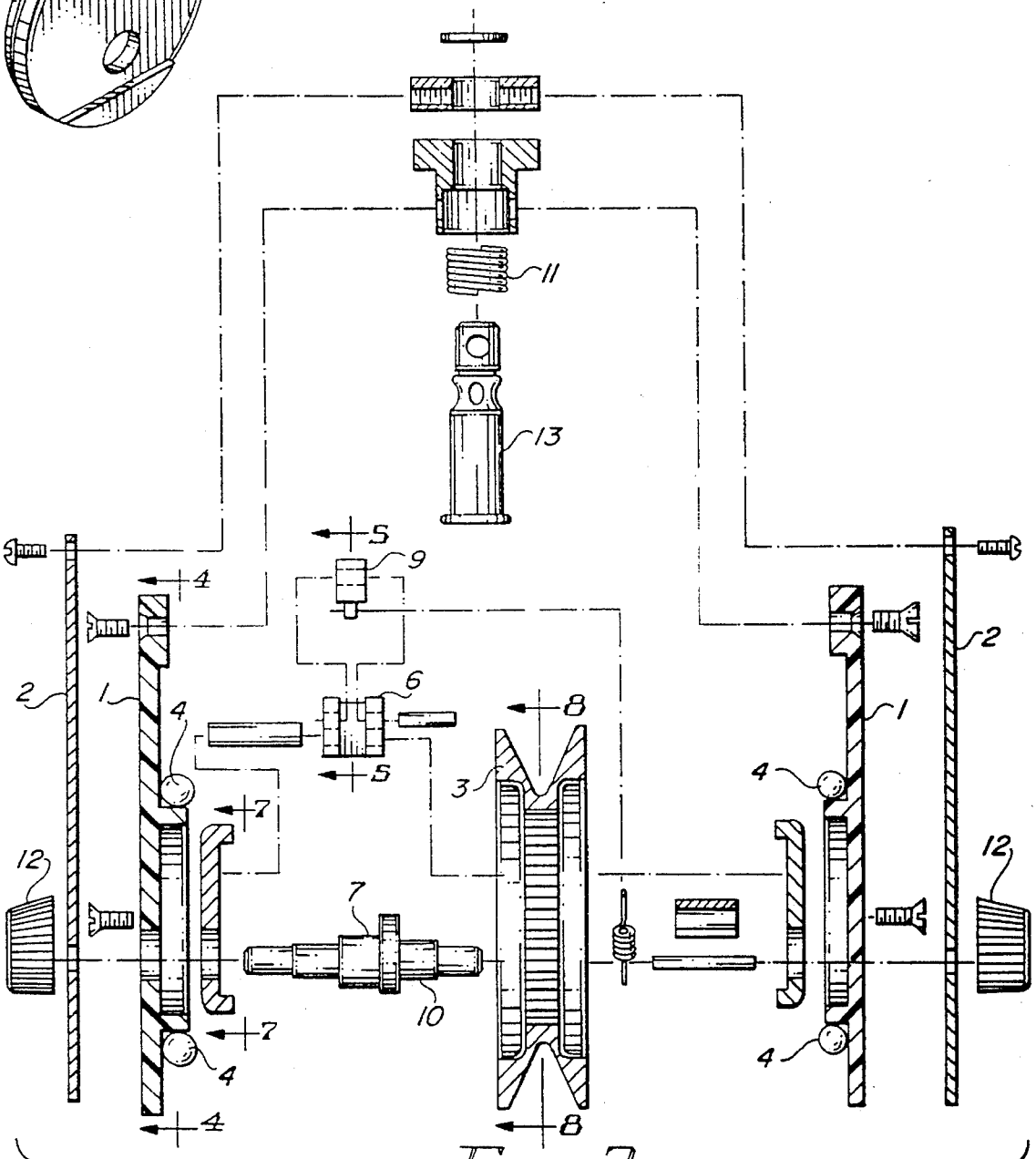
FIG. 3 is an exploded transverse vertical view of the ratchet block components.

FIG. 3 is an exploded transverse section of the ratchet block showing most of the critical components.

Figure 4:
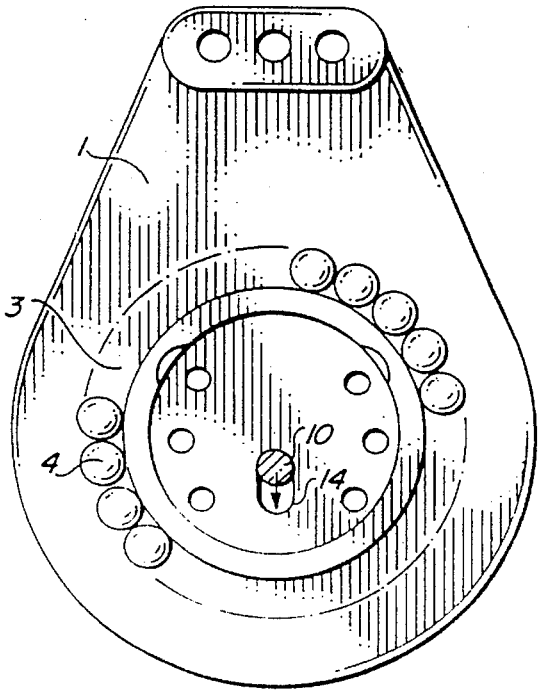
FIG. 4 is an internal side view of the sheave assembly, sheave, and ball bearings.

FIG. 4 is an internal side view of one side of the sheave assembly 1, sheave 3, and ball bearings 4. The shaft 10 can provide means for rotation of the sheave 3 in two different positions as the shaft aperture 14 is oval. When a load is placed on the sheave 3, the sheave assembly 1 moves toward the load and the sheave 3 rotates in the top part of the oval aperture 14.

Figure 5:
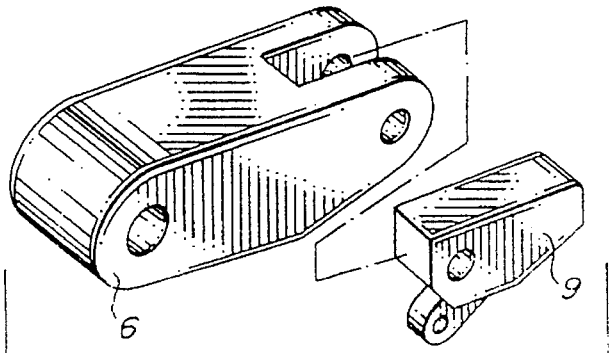
FIG. 5 is a side view of the articulated ratchet arm with its two parts separated.
Figure 6:
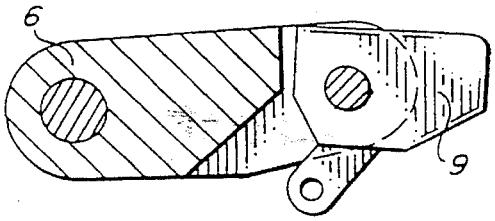
FIG. 6 shows the articulated ratchet arm.

FIGS. 5 and 6 show the articulated ratchet arm 6 assembled and separated into its two parts. The teeth engaging end 9 of the ratchet arm rotates on a small shaft to allow movement for the ratcheting mode.

Figure 7:
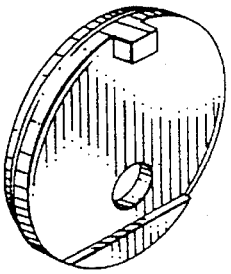
FIG. 7 shows one of two cam retaining plates of the sheave assembly.

FIG. 7 shows cam retaining plate or disk 15. There are two such cam retaining plates 15 and 16, as seen in FIGS. 2 and 3.

Figure 8:
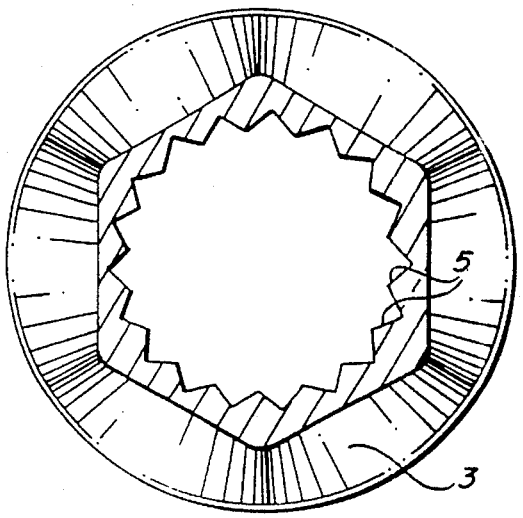
FIG. 8 is an internal side view of the teeth on the inside of the sheave.

FIG. 8 shows the sheave 3 and the teeth 5 on the inside which become engaged by the teeth engaging end 9 of the articulated ratchet arm 6.

Figure 9:
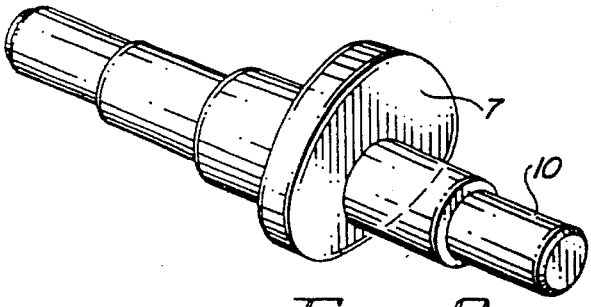
FIG. 9 shows the cam fixed to the ratchet block shaft.

FIG. 9 shows the cam 7 fixed on the shaft 10. The cam 7 has three radii to enable it to be set in three different positions per the aforementioned description of the switch 12 in FIG. 1.

Figure 10:
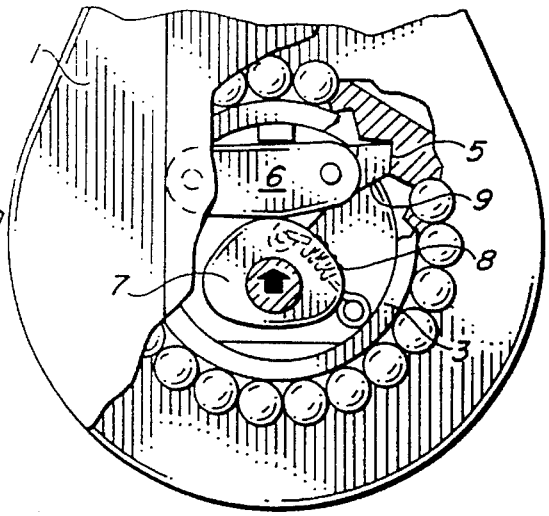
FIG. 10 is an internal side view of the ratchet assembly with cam in the automatic mode.

FIG. 10 is an internal side view of the lower part of the ratchet block and sheave assembly 1 with the cam 7 engaging the ratchet arm 6 and the teeth engaging end of the ratchet arm 9 locked between sheave teeth 5 so the sheave 3 cannot rotate in the counter clockwise direction. The ratchet spring 8 serves two functions, holding the larger part of the articulated ratchet arm 6 against the cam 7, and permitting the teeth engaging end 9 to move in the direction of rotation when the sheave 3 rotates in a clockwise direction, and to spring back (ratcheting) in between the teeth 5 when clockwise rotation stops. The cam 7 is in the automatic mode which allows engagement of the ratchet arm 6 only when the sheave assembly 1 is under load.

Figure 11:
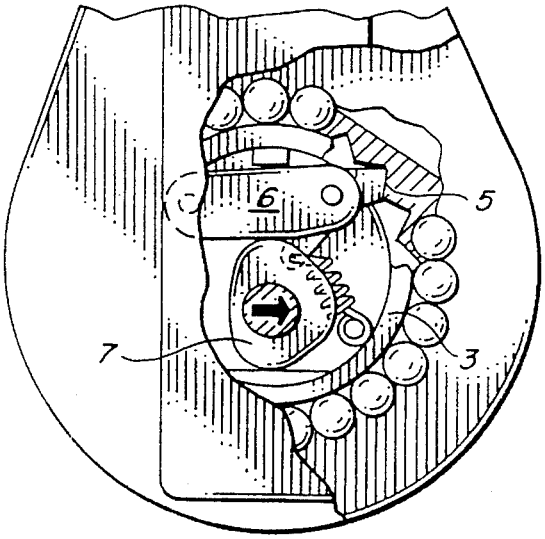
FIG. 11 is an internal side view of the ratchet assembly with cam in the on mode.

FIG. 11 is an internal side view similar to FIG. 10 except that the cam 7 is in the on position, forcing the ratchet arm 6 to engage the sheave teeth 5 whether or not there is a load placed on the sheave 4.

Figure 12:
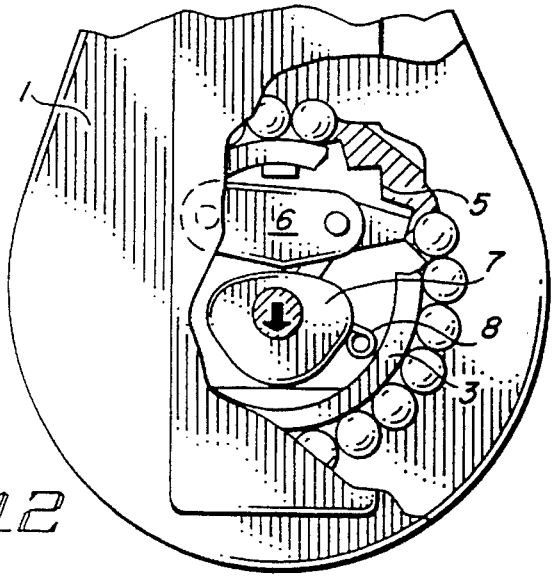
FIG. 12 is an internal side view of the ratchet assembly with cam in the off mode.

FIG. 12 is an internal side view similar to FIGS. 10 and 11 except that the cam 7 is in the off position, enabling the ratchet arm 6 to be pulled far enough away from the sheave teeth 5 by the ratchet spring 8 so that ratcheting will not occur whether or not there is a load on the sheave 3.

FIGS. 13 to 18 show a modification of our invention. In the original version, the sheave assembly is fixed relative to the cheeks of the block, and the pawl and cam assembly move as a function of load. In the modification, the sheave assembly moves under the load, and the pawl assembly is fixed relative to the cheeks. This modification provides several advantages: The movable portion of the assembly is now totally contained within the block itself, and no movable parts are exposed to the exterior; fewer and simpler parts are required; the overall carrying capacity of the mechanism is increased; and the total travel necessary to actuate the mechanism has been reduced from about 0.120" to about 0.030".

Figure 13:
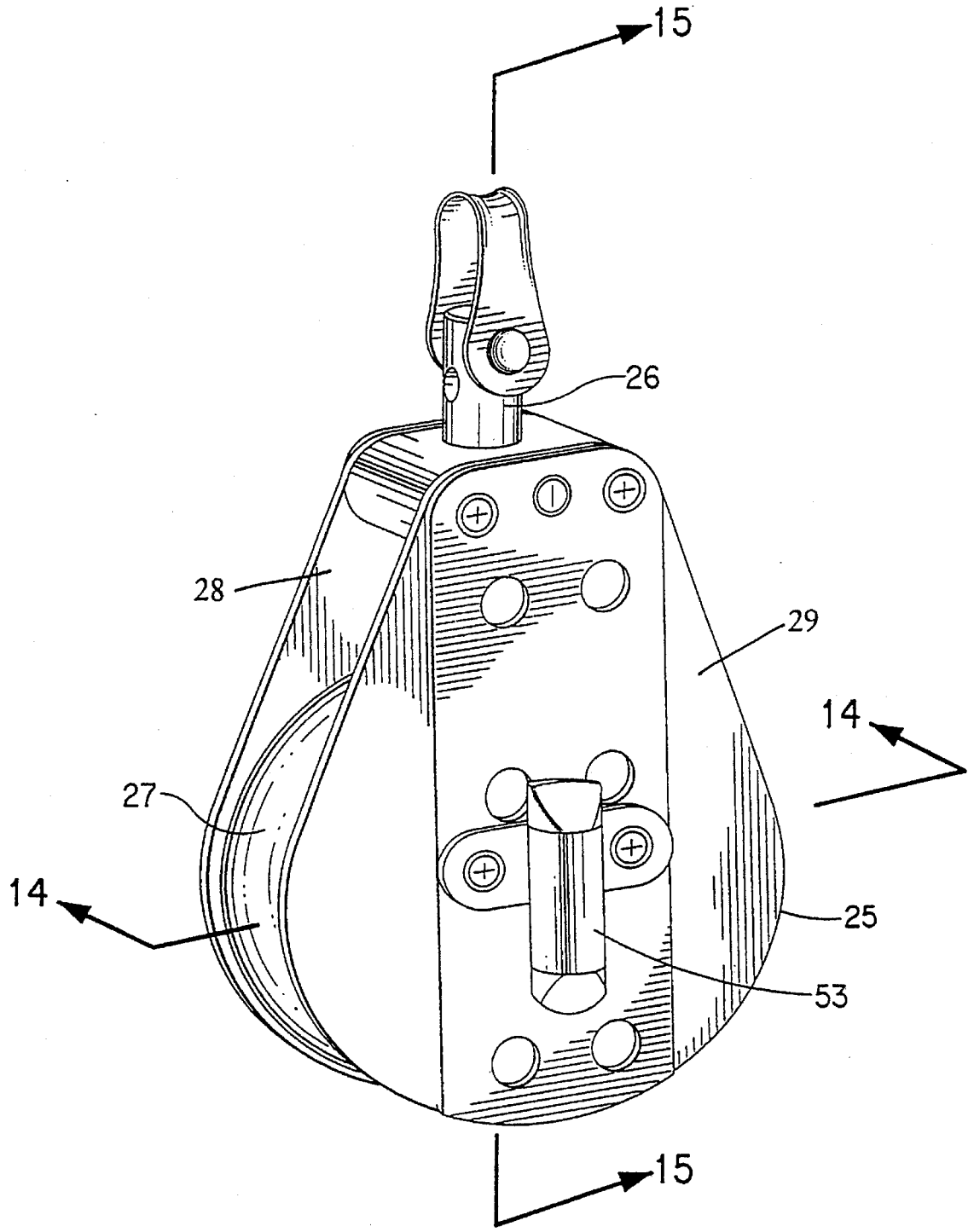
FIGS. 13 to 18 show a modification of our invention.

FIG. 13 is a perspective view of the modified ratchet block. It includes frame 25 with centerpost 26, carrying sheave 27, walls 28 and 29, and upper end 30. Sheave 27 is mounted so as to be movable; that is, the sheave can move a short distance (about 0.030" total) in a direction toward and away from centerpost 26. This movement takes place when the block is carrying a load.

Figure 15:
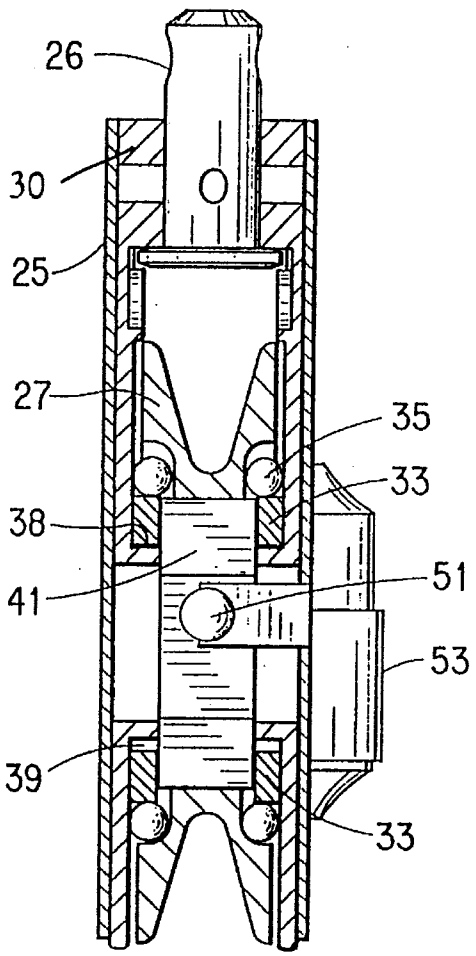
Figure 14:
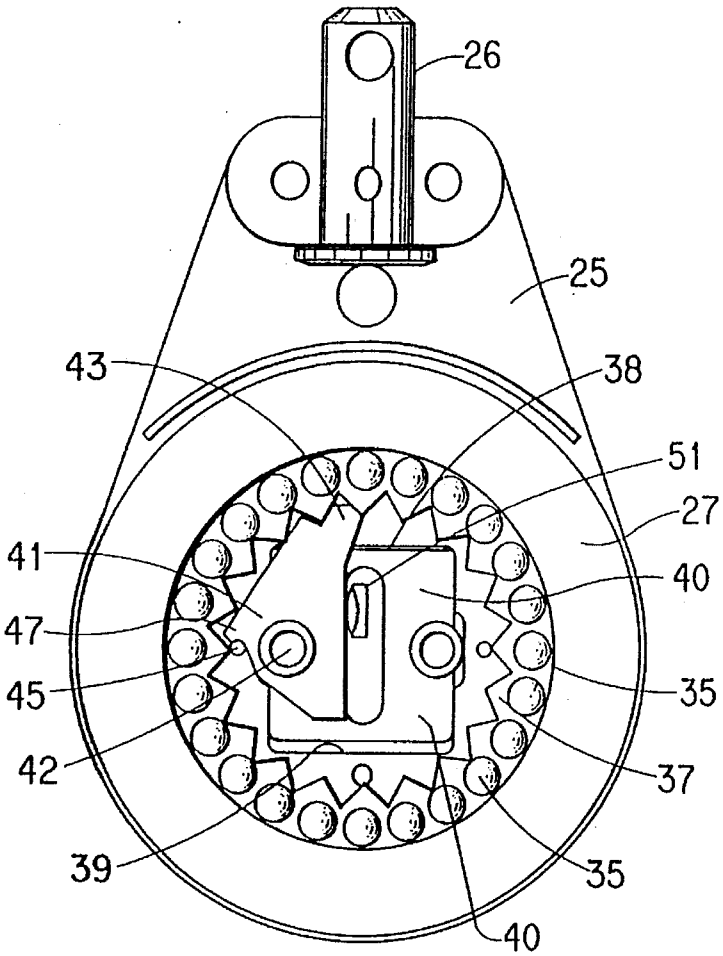

FIGS. 14 and 15 show internal details of the block when the block is under load. Sheave 27 is mounted in frame 25 for up and down vertical movement. Under load, as it is here, the sheave is in its downward position. The sheave is carried by raceway 33, with ball bearings 35, and includes inwardly-facing teeth 37.

An opening 39 in the raceway serves to admit the ratchet assembly 40. This assembly includes pawl 41 with teeth 43. These teeth engage teeth 37 when the block is under load conditions. Pawl 41 is pivotally mounted on pivot 42, which is an integral part of frame 25. Spring 51 presses the pawl into engagement with sheave teeth 37. To assure disengagement when under no-load conditions, however, the pawl includes a finger 47 which can engages pin 45. The pin is so positioned that the pawl can engage with teeth 37 under load conditions, but will serve to remove the pawl from such engagement under no-load conditions. Slide switch 53 moves ratchet spring 51 up and down; it is disengaged when in the down position.

A leaf spring 38 is positioned in opening 39 between the upper edge of ratchet assembly 40 and the top edge of the opening 39. The spring 38 acts as a means to direct the sheave 27 toward upper end 30 and as a means normally tending to move the sheave and ratchet assembly away from one another. Spring 38 serves to press ratchet assembly 40 downwardly, out of engagement. Downward pressure on sheave 27, from a load, compresses spring 38 and enables pawl teeth 43 to engage with sheave teeth 37.

Figure 17:
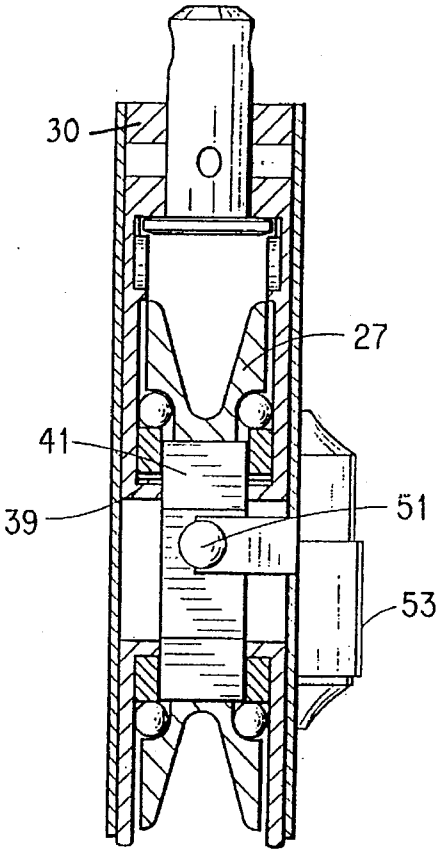
Figure 16:
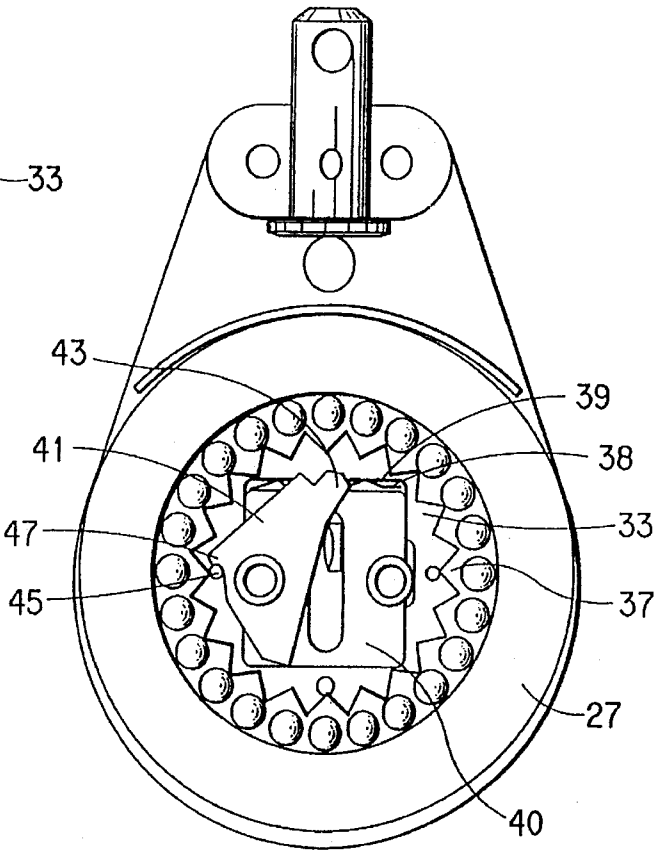
Figure 18:
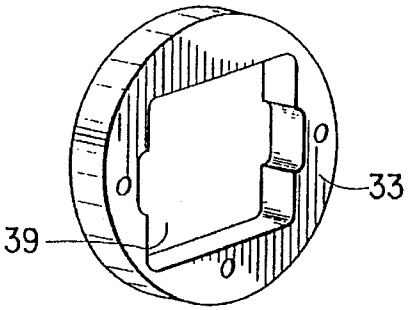

By comparing FIGS. 14 and 15 (sheave under load) with FIGS. 16 and 17 (no load), it can be seen that the ratchet assembly 40 is in the upper portion of opening 39 (see gap at bottom of opening 39) when the sheave is under load; and it is in the lower portion of opening 39 (gap at top of opening) when the sheave is not under load. This means that, under load, pawl teeth 43 engage with sheave teeth 37, assisted by pressure from ratchet spring 51, and are not prevented from meshing by engagement of pin 45 with pawl finger 47. This also means that the sheave can rotate only in a clockwise direction relative to pawl 41, i.e., the direction permitting a user to take up slack on a line. Since the sheave is locked against rotation in the opposite direction, line will not pay out as well.

As can be seen in FIG. 16, however, pin 45 engages with finger 47 under no-load conditions, forcing pawl teeth 43 out of engagement with sheave teeth 37. Pin 45 serves as means preventing interengagement of the teeth 37 with the ratchet arm pawl 41. In this latter event, the sheave is free to rotate in either direction. This is desired under no-load conditions.

We claim:

1. A ratchet block adapted for self-locking, said ratchet block including a frame having an upper end, a sheave mounted within said frame for movement toward and away from said upper end, said sheave having sheave teeth extending radially inwardly, a ratchet assembly fixedly mounted within said frame in operative relationship with said sheave, said ratchet assembly including a ratchet arm pivotally mounted for engagement with said sheave teeth when said sheave is in a position away from said upper end, pressing means pressing said ratchet arm toward interengagement with said sheave teeth, and releasing means pressing said ratchet arm away from said interengagement when said sheave is in a position toward said upper end, said releasing means including a pin mounted on said frame and a pin-engaging member on said ratchet arm positioned for cooperative engagement with said pin to press said ratchet arm away from said sheave teeth when said sheave is in a position toward said upper end.

* * * * *